US011175609B1

(12) United States Patent
Akamatsu et al.

(10) Patent No.: US 11,175,609 B1
(45) Date of Patent: Nov. 16, 2021

(54) BELT ROTATING DEVICE WITH CLEANING DEVICE AND IMAGE FORMING APPARATUS

(71) Applicant: FUJIFILM Business Innovation Corp., Tokyo (JP)

(72) Inventors: Hiroaki Akamatsu, Kanagawa (JP); Hideyuki Otani, Kanagawa (JP); Kazuya Yasui, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/144,261

(22) Filed: Jan. 8, 2021

(30) Foreign Application Priority Data

Sep. 23, 2020 (JP) ..... JP2020-158279

(51) Int. Cl.
*G03G 15/16* (2006.01)
*G03G 21/00* (2006.01)
*G03G 15/00* (2006.01)

(52) U.S. Cl.
CPC ..... *G03G 15/161* (2013.01); *G03G 15/50* (2013.01); *G03G 21/0041* (2013.01)

(58) Field of Classification Search
CPC .. G03G 15/161; G03G 15/166; G03G 15/168; G03G 15/50
USPC ..... 399/71, 101, 302
See application file for complete search history.

(56) References Cited

U.S. PATENT DOCUMENTS 5,784,674 A * 7/1998 Iseki et al. ..... G03G 15/166 399/297
6,259,882 B1 * 7/2001 Lindblad et al. .. G03G 21/0005 399/352
6,292,637 B1 * 9/2001 Lindblad et al. .. G03G 21/0005 399/350
7,809,305 B2 * 10/2010 Takuwa ..... G03G 15/161 399/302
9,026,016 B2 * 5/2015 Nakaegawa ..... G03G 15/1615 399/302
10,409,202 B2 * 9/2019 Nakamura et al. ..... G03G 15/1615

FOREIGN PATENT DOCUMENTS

JP 2018-097316 A 6/2018

* cited by examiner

*Primary Examiner* — William J Royer
(74) *Attorney, Agent, or Firm* — Sughrue Mion, PLLC

(57) ABSTRACT

A belt rotating device includes a belt wound around plural rollers to circulate and move, the plural rollers including a roller to be cleaned; and a first cleaning unit disposed inside the belt, the first cleaning unit being in contact with at least the roller to be cleaned to scrape off foreign matter on the roller to be cleaned, the first cleaning unit being configured to change a contact state with respect to the roller to be cleaned.

20 Claims, 5 Drawing Sheets

BELT ROTATING DEVICE WITH CLEANING DEVICE AND IMAGE FORMING APPARATUS

CROSS-REFERENCE TO RELATED APPLICATIONS

This application is based on and claims priority under 35 USC 119 from Japanese Patent Application No. 2020-158279 filed Sep. 23, 2020.

BACKGROUND

(i) Technical Field

The present disclosure relates to a belt rotating device and an image forming apparatus.

(ii) Related Art

There is an image forming apparatus that forms an image on an intermediate transfer belt and transfers the image to an object to be transferred such as a sheet.

One of image defects that may occur in this type of image forming apparatus is an image defect called a stapler mark in which two dark dots appear side by side in a width direction intersecting a process direction such as a traveling direction of the intermediate transfer belt and a sheet transport direction.

This image defect is caused by a foreign matter adhering to a roller supporting the intermediate transfer belt, and the intermediate transfer belt is lifted by a height of a portion to which the foreign matter adheres, and therefore portions on both sides of the lifted portion are poorly cleaned.

Here, JP-A-2018-097316 discloses a cleaning unit configured to press an elastic sheet against an outer peripheral surface of a driving roller that drives an intermediate transfer belt to scrape off toner and the like that are foreign matter attached to the outer peripheral surface of the driving roller. JP-A-2018-097316 discloses that providing this cleaning unit prevents a decrease in a friction coefficient between a belt and a driving roller due to adhering of the toner and the like, to stably achieve a friction force necessary for belt skew correction.

SUMMARY

The foreign matter adhering to the roller supporting the intermediate transfer belt is not always the same type of foreign matter.

Various foreign matter such as minute fragments of a resin component constituting a device may adhere to the roller. No matter what foreign matter adheres, the above-described "stapler mark" may be generated.

Here, when the elastic sheet is pressed against the roller to remove the foreign matter adhering to the roller, a contact state between the elastic sheet and the roller, such as an abutment angle, may cause the following phenomenon. That is, depending on the contact state, some type of foreign matter is removed from the roller, but another type of foreign matter is not easily removed.

Aspects of non-limiting embodiments of the present disclosure relate to a belt rotating device capable of removing plural types of foreign matter and an image forming apparatus including the belt rotating device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a belt rotating device including a belt wound around plural rollers to circulate and move, the plural rollers including a roller to be cleaned; and a first cleaning unit disposed inside the belt, the first cleaning unit being in contact with at least the roller to be cleaned to scrape off foreign matter on the roller to be cleaned, the first cleaning unit being configured to change a contact state with respect to the roller to be cleaned.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described.

Figure 1:
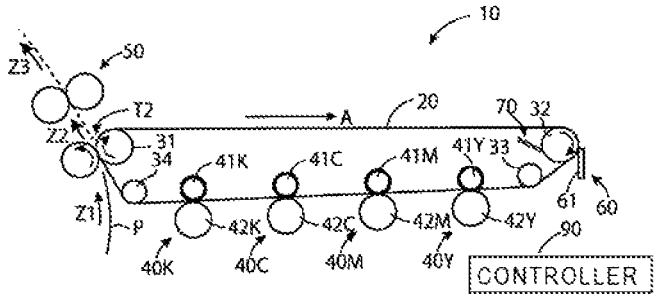
FIG. 1 is a schematic diagram illustrating a part of an image forming apparatus according to a first exemplary embodiment of the present disclosure.

FIG. 1 is a schematic diagram illustrating a part of an image forming apparatus according to a first exemplary embodiment of the present disclosure. This image forming apparatus includes a belt rotating device according to the first exemplary embodiment of the present disclosure. An image forming apparatus 10 is, for example, an electrostatic transfer image forming apparatus using toner.

The image forming apparatus 10 includes an intermediate transfer belt 20. The intermediate transfer belt 20 is wound around plural rollers 31 to 34 including a driving roller 31 and a tension roller 32. The intermediate transfer belt 20 is driven by the driving roller 31 to circulate and move in a direction of an arrow A. The tension roller 32 is a roller that is pressed by a spring member (not illustrated) to apply tension to the intermediate transfer belt 20.

Four primary transfer rollers 41Y, 41M, 41C, and 41K are provided inside the intermediate transfer belt 20. Here, for reference signs 41Y, 41M, 41C, and 41K of the primary transfer rollers 41Y, 41M, 41C, and 41K, suffixes "Y", "M", "C", and "K" correspond to colors of the toner. When there is no need to distinguish the colors of the toner, the suffixes for distinguishing the colors may be omitted, and the four primary transfer rollers may be called as the "primary transfer rollers 41". The same applies to the other elements provided corresponding to the colors of the toner.

Image forming engines 40Y, 40M, 40C, and 40K provided at positions where the image forming engines-engines 40 respectively face the four primary transfer rollers 41 with the intermediate transfer roller 20 sandwiched there between. Each image forming engine 40 includes an image 42Y, 42M, 42C, and 42K. A toner image of each color is formed on a respective one of the image carriers 42 by elements (not illustrated). Then, the toner images on the image carriers 42 are sequentially transferred onto the intermediate transfer belt 20 by actions of the primary transfer rollers 41 in synchronization with the circular movement of the intermediate transfer belt 20 in the direction of the arrow A such that the toner images are overlapped with each other. Positions where the primary transfer rollers 41 are disposed are an example of an "image formation position" of the present disclosure. The toner images sequentially transferred so as to be overlapped with each other are transported to a secondary transfer position T2 in accordance with the circular movement of the intermediate transfer belt 20.

Meanwhile, a sheet P is taken out from a sheet tray (not illustrated) and transported in a direction of an arrow Z1 so as to reach the secondary transfer position T2 at a timing at which the toner image on the intermediate transfer belt 20 is transported to the secondary transfer position T2. Then, at the secondary transfer position T2, the toner image on the intermediate transfer belt 20 is transferred onto the sheet P. This secondary transfer position T2 is an example of a "transfer position" of the present disclosure.

The sheet P onto which the toner image is transferred proceeds in a direction of an arrow Z2 and is heated and pressurized by a fixing unit 50. Accordingly, the toner image on the sheet P is fixed on the sheet P. Then, the sheet P on which an image formed of the fixed toner image is formed further proceeds in a direction of an arrow Z3 and is discharged to an outside of the image forming apparatus 10.

Residual toner on the intermediate transfer belt 20 after the transfer proceeds in the direction of the arrow A in accordance with the circular movement of the intermediate transfer belt 20, and is removed from the intermediate transfer belt 20 by a cleaning device 60 including a cleaning blade 61 pressed against the tension roller 32 with the intermediate transfer belt 20 sandwiched therebetween.

The image forming apparatus 10 includes another cleaning device 70. The cleaning device 70 is disposed inside the intermediate transfer belt 20, and is in direct contact with the tension roller 32 without the intermediate transfer belt 20 sandwiched therebetween, to scrape off the foreign matter adhering to the tension roller 32. The cleaning device 70 will be described in detail later.

The cleaning device 70 disposed inside the intermediate transfer belt 20 is an example of a "first cleaning unit" of the present disclosure. The cleaning device 60 disposed outside the intermediate transfer belt 20 is an example of a "second cleaning unit" of the present disclosure. The tension roller 32 is an example of a "roller to be cleaned" of the present disclosure.

The image forming apparatus 10 illustrated in FIG. 1 further includes a controller 90. In the image forming apparatus 10, the above-described series of operations are executed under control of the controller 90. The controller 90 is an example of a "measuring unit" of the present disclosure. A function of the measuring unit will be described later.

Figure 2A:
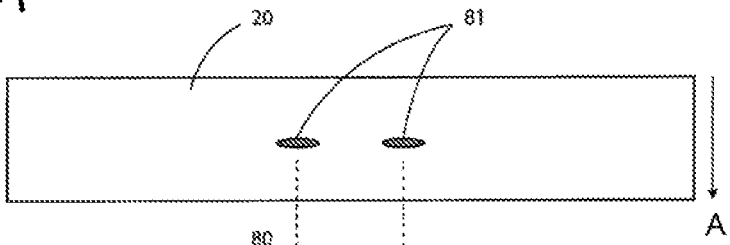
FIGS. 2A and 2B are diagrams illustrating an image defect that may occur when no cleaning device is disposed inside an intermediate transfer belt or when a cleaning device is disposed but an action of the cleaning device is insufficient.
Figure 2B:
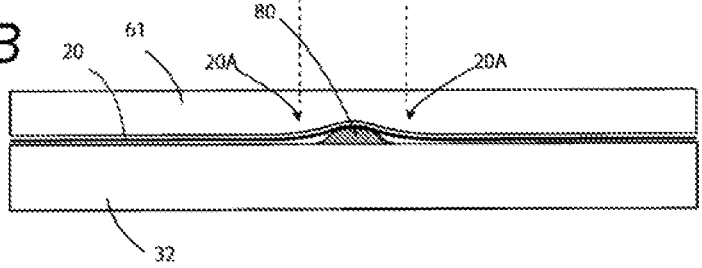

FIGS. 2A and 2B are diagrams illustrating an image defect that may occur when no cleaning device is disposed inside an intermediate transfer belt or when a cleaning device is disposed but an action of the cleaning device is insufficient. Here, FIG. 2A illustrates a surface of the intermediate transfer belt after passing through the cleaning blade. FIG. 2B is a cross-sectional view of a portion of the intermediate transfer belt where the cleaning blade is pressed.

Here, foreign matter 80 such as a toner mass adheres to the tension roller 32. Then, a portion of the intermediate transfer belt 20 riding on the foreign matter 80 is pressed by the foreign matter 80 and bends, and downwardly convex dents 20A are formed on both sides of the portion of the intermediate transfer belt 20 riding on the foreign matter 80. The cleaning blade 61 is difficult to hit the convex dents 20A on both sides of the foreign matter 80, and residual toner 81 at this portion may remain on the intermediate transfer belt 20. When the residual toner 81 remains on the intermediate transfer belt 20, the residual toner 81 is transferred onto the sheet together with a toner image that is formed next time, and an image defect called a stapler mark as illustrated in FIG. 2A may occur on the sheet. The image forming apparatus 10 of the present exemplary embodiment reduces this type of image defect.

Figure 3A:
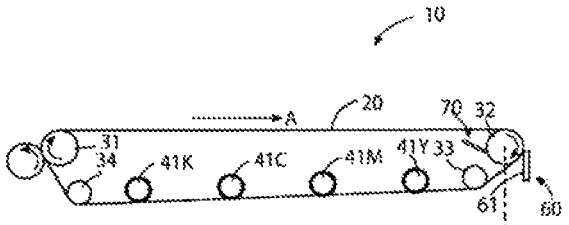
FIGS. 3A and 3B are diagrams illustrating mode switching in the image forming apparatus of the present exemplary embodiment.
Figure 3B:
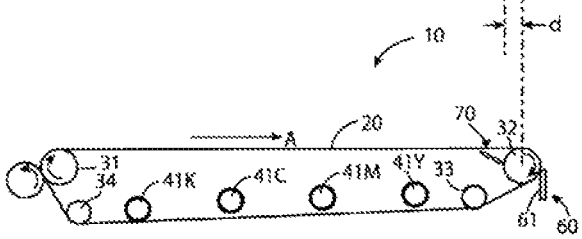

FIGS. 3A and 3B are diagrams illustrating mode switching in the image forming apparatus of the present exemplary embodiment.

FIG. 3A illustrates a color mode for forming a color image on a sheet. FIG. 1 illustrates an arrangement position of each member in this color mode. In FIG. 3A, each member is in the same arrangement position as in FIG. 1.

FIG. 3B illustrates a monochrome mode for forming a monochrome image on a sheet. Here, only the primary transfer roller 41K for a black toner image among the four primary transfer rollers 41Y, 41M, 41C, and 41K is in contact with the intermediate transfer belt 20, and the three primary transfer rollers 41Y, 41M, and 41C for toner images of colors other than black are moved away from the intermediate transfer belt 20. Due to a mechanical structure that moves these three primary transfer rollers 41Y, 41M, and 41C away from the intermediate transfer belt 20, the tension roller 32 and the cleaning blade 61 are moved by a distance d as compared with the color mode. The distance d is, for example, about 1 mm to about 2 mm. It is noted that a position of the cleaning device 70 disposed inside the intermediate transfer belt 20 is the same as in the color mode. The color mode and the monochrome mode in the present exemplary embodiment are an example of a "first mode" of the present disclosure and an example of a "second mode" of the present disclosure, respectively.

Figure 4A:
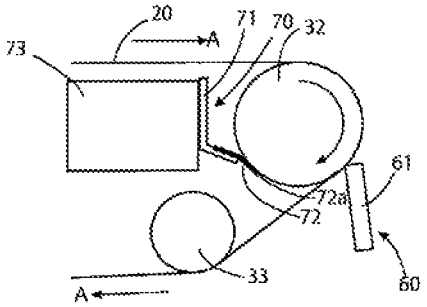
FIGS. 4A and 4B are views illustrating a vicinity of a tension roller in an enlarged manner compared to FIGS. 3A and 3B.
Figure 4B:
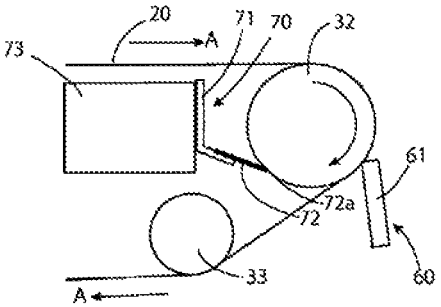

FIGS. 4A and 4B are views illustrating a vicinity of the tension roller in an enlarged manner compared to FIGS. 3A and 3B. Here, FIGS. 4A and 4B correspond to FIGS. 3A and 3B, respectively. That is, FIG. 4A illustrates an arrangement of the members in the color mode, and FIG. 4B illustrates an arrangement of the members in the monochrome mode.

FIGS. 4A and 4B illustrate the cleaning device 70 disposed inside the intermediate transfer belt 20. The cleaning device 70 has a structure in which a blade 72 is fixed to a leading end of a housing 71. In the present exemplary embodiment, the blade 72 includes, for example, a PET film. A leading end edge 72*a* of the blade 72 is in contact with the tension roller 32. The housing 71 is fixed to a support member 73. The support member 73 has a length such that both sides of the support member 73 in a rotation axis direction of the tension roller 32, that is, in a width direction of the intermediate transfer belt 20 protrude from the intermediate transfer belt 20. The both sides of the support member 73 protruding from the intermediate transfer belt 20 are fixed to a frame (not illustrated) of the image forming apparatus 10.

When the color mode of FIG. 4A and the monochrome mode of FIG. 4B are compared, as described with reference to FIGS. 3A and 3B, the tension roller 32 is moved to a position farther from the support member 73 in the monochrome mode in FIG. 4B. Therefore, the blade 72 of the cleaning device 70 is more strongly pressed and bent in the color mode in FIG. 4A, and more weakly pressed and bent in the monochrome mode in FIG. 4B. That is, a contact state of the blade 72 changes between the color mode and the monochrome mode.

Figure 5:
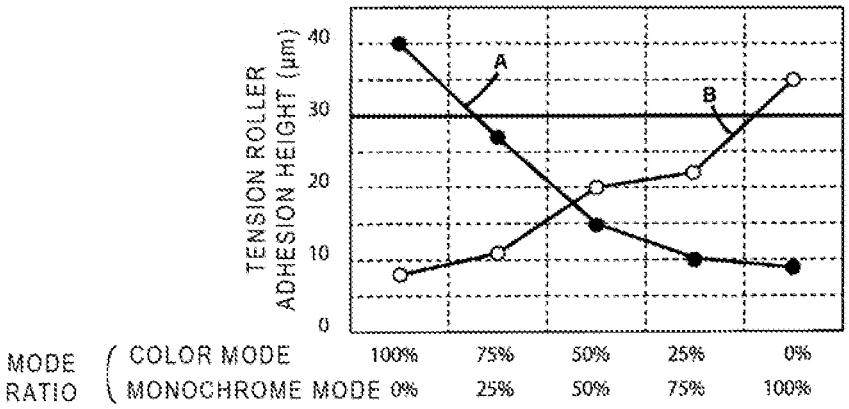
FIG. 5 is a diagram illustrating a removal performance of a cleaning device that removes foreign matter adhering to the tension roller, in removing the foreign matter.

FIG. 5 is a diagram illustrating a removal performance of the cleaning device that removes foreign matter adhering to the tension roller, in removing the foreign matter. A horizontal axis represents a mode ratio between the color mode and the monochrome mode, and a vertical axis represents a tension roller adhesion height (μm). It is preferable that the tension roller adhesion height (μm) is low. It is assumed here that a target height is equal to or less than 30 μm.

Here, use in an experiment is a tension roller onto which a large number of toner masses and resin fragments adheres and on which stapler marks are confirmed. As a result of examination before the experiment, a large number of foreign matter that have a height of 60 μm to 80 μm and may cause the stapler marks are found. Then, it is assumed that one job includes printing 100 sheets at an image density of 5%, and a total of 1000 jobs are carried out while changing the mode ratio. A graph A shows maximum heights of the toner mass remaining on and adhering to the tension roller after the experiment under this condition. A graph B shows maximum heights of the resin fragments remaining on and adhering to the tension roller after the experiment under this condition. A lower maximum height means a higher removal performance.

As illustrated in FIG. 5, the removal performance in removing the toner increases as the ratio of the color mode increases, and the removal performance in removing the resin fragment increases as the ratio of the monochrome mode increases.

Figure 6A:
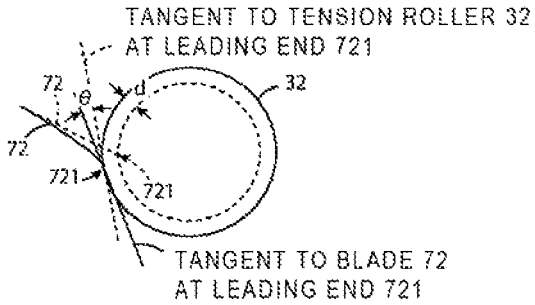
FIGS. 6A to 6C are diagrams illustrating that removal performances of the cleaning device in removing toner and resin differ depending on a contact state of a blade of the cleaning device.
Figure 6B:
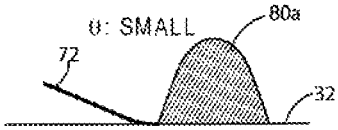
Figure 6C:
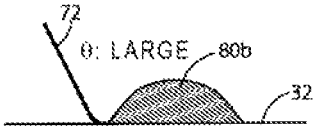

FIGS. 6A to 6C are diagrams illustrating that performances of the cleaning device in removing toner and resin differ depending on the contact state of the blade of the cleaning device. FIG. 6A also illustrates definitions of a contact angle ( ) and a bite amount d.

FIG. 6A illustrates a state in which a leading end 721 of the blade 72 is in contact with the tension roller 32. The contact angle θ refers to an angle between a tangent to the tension roller 32 and a tangent to the blade 72 at the leading end 721.

As illustrated with a broken line in FIG. 6A, the bite amount d refers to a length of the tension roller 32 in a radial direction between a surface of the tension roller 32 and the leading end 721 of the blade 72 when assuming that the blade 72 bites into the tension roller 32 without resistance.

FIG. 6B is a schematic diagram of the color mode. In the color mode, the tension roller 32 is closer to the support member 73 (see FIGS. 4A and 4B) than in the monochrome mode. Therefore, the blade 72 is more strongly pressed by the tension roller 32, and the contact angle θ in the definition illustrated in FIG. 6A becomes small. When this is expressed by the bite amount d, the bite amount d becomes large in the color mode illustrated in FIG. 6B. In this case, a foreign matter 80*a* of a resin piece is easily removed. That is, the foreign matter 80*a* of the resin piece is a mass, and it is difficult to scrape the foreign matter 80*a* of the resin piece little by little. Therefore, the contact angle θ (increase the bite amount d) is decreased such that the foreign matter 80*a* is peeled off from the tension roller 32.

FIG. 6C is a schematic diagram of the monochrome mode. In the monochrome mode, the tension roller 32 is farther away from the support member 73 (see FIGS. 4A and 4B) than in the color mode. Therefore, the blade 72 is more weakly pressed by the tension roller 32, and the contact angle θ illustrated in FIG. 6B becomes large. When this is expressed by the bite amount d, the bite amount d becomes small in the monochrome mode illustrated in FIG. 6C. In this case, a foreign matter 80*b* of the toner is easily removed. That is, when the tension roller 32 abuts against the blade 72 at the large abutment angle θ, the foreign matter 80*b* of the toner is gradually scraped.

As illustrated in this example, different types of foreign matters are removed by changing the contact state such as the contact angle.

Figure 7:
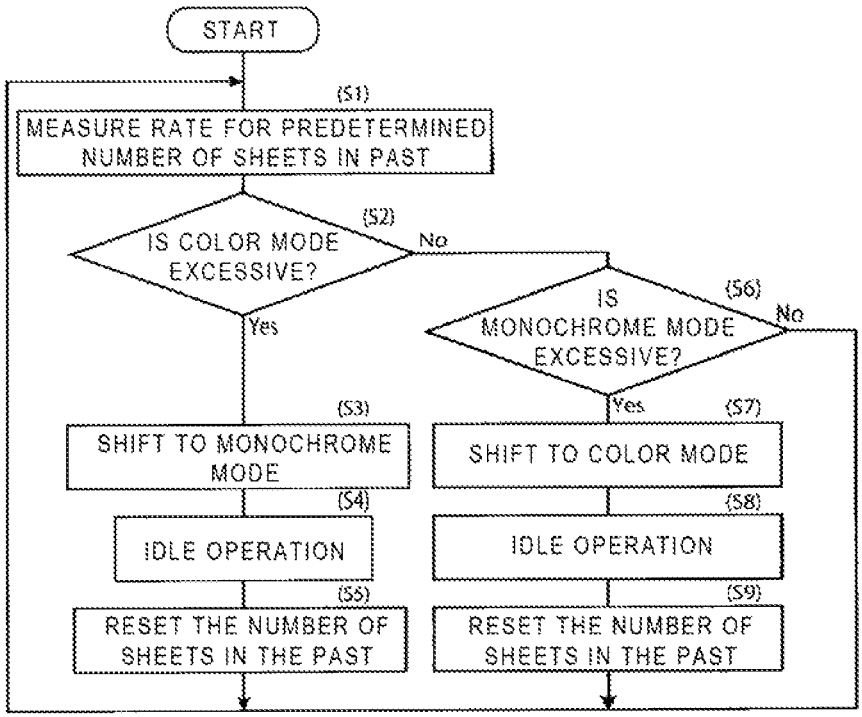
FIG. 7 illustrates a sequence of determining a timing at which a cleaning mode is carried out in the present exemplary embodiment.

FIG. 7 illustrates a sequence of determining a timing at which a cleaning mode is carried out in the present exemplary embodiment.

As illustrated in FIGS. 6A and 6B, different types of foreign matters are removed by selectively using the color mode and the monochrome mode. However, this means that when the image forming apparatus 10 is used in almost only one mode, only one type of the foreign matter is removed. Therefore, in the present exemplary embodiment, as illustrated in FIG. 7, the ratio of each mode is measured, and when the ratio of one mode is high, the mode is shifted to the cleaning mode.

Here, first, every time 100 images are formed, a ratio between the color mode and the monochrome mode in image formation for the predetermined number of sheets (for example, 1000 sheets) in the past is measured (step S1). Then, when the color mode is excessive beyond a predetermined ratio (for example, 80%) (step S2), the mode shifts to the monochrome mode (step S3), and an idle operation which is the cleaning mode is executed for a predetermined time (step S4). Here, the idle operation refers to circulating and moving the intermediate transfer belt 20 without transporting a sheet or without forming a toner image to be transferred onto a sheet.

Once the idle operation is executed, the number of accumulated sheets in the past for which the ratio is to be measured in step S1 is reset to zero (step S5). When the number of accumulated sheets in the past is reset, the ratio is measured next in step S1 after the predetermined number of images (for example, 1000 sheets) are formed in future.

In step S1, when the color mode is lower than the predetermined ratio (for example, 80%), then it is determined whether the monochrome mode exceeds the predetermined ratio (for example, 80%) (step S6). Then, when the monochrome mode is excessive beyond the predetermined ratio (for example, 80%), the mode shifts to the color mode (step S7), and the idle operation which is the cleaning mode is executed for a predetermined time (step S8). In this case, after the idle operation is executed, the number of accumulated sheets in the past for which the ratio is to be measured in step S1 is reset to zero (step S9).

In step S6, when the monochrome mode is lower than the predetermined ratio (for example, 80%), a process returns to step S1 without doing anything. At this time, after 100 images are formed next, the ratio is measured again in step S1.

The sequence illustrated in FIG. 7 is executed in the controller 90 illustrated in FIG. 1. Therefore, a measurement function, performed in step S1, of the controller 90 is an example of a "measuring unit" of the present disclosure.

Figure 8A:
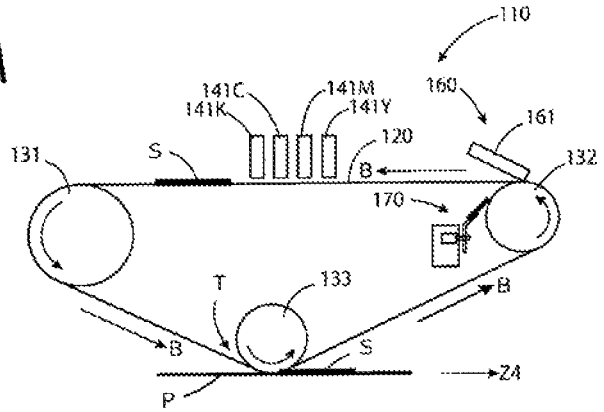
FIG. 8A is a schematic diagram illustrating a part of an image forming apparatus according to a second exemplary embodiment of the present disclosure.
Figure 8B:
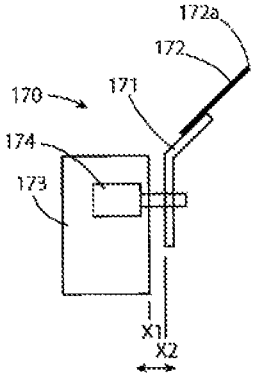
FIG. 8B is a schematic diagram illustrating a cleaning device inside an intermediate transfer belt.

FIG. 8A is a schematic diagram illustrating a part of an image forming apparatus according to a second exemplary embodiment of the present disclosure. FIG. 8B is a schematic diagram illustrating a cleaning device inside an intermediate transfer belt. This image forming apparatus includes a belt rotating device according to the second exemplary embodiment of the present disclosure. An image forming apparatus 110 is an inkjet image forming apparatus.

The image forming apparatus 110 includes an intermediate transfer belt 120. The intermediate transfer bell 120 is wound around a driving roller 131, a tension roller 132, and a transfer roller 133. The intermediate transfer belt 120 is driven by the driving roller 131 to circulate and move in a direction of an arrow B. The tension roller 132 is a roller that is pressed by a spring member (not illustrated) to apply tension to the intermediate transfer belt 120. The transfer roller 133 will be described later.

Four nozzles 141Y, 141M, 141C, and 141K that form images on the intermediate transfer belt 120 by an inkjet method are provided above the intermediate transfer belt 120. Here, among reference signs 141Y, 141M, 141C, and 141K of the nozzles 141Y, 141M, 141C, and 141K, suffixes "Y", "M", "C", and "K" correspond to colors of ink. When there is no need to distinguish the colors of the ink, the suffixes for distinguishing the colors may be omitted, and the four nozzles may be called as the "nozzles 141".

The ink is ejected onto the intermediate transfer belt 120 from the nozzles 141. Images are sequentially formed on the intermediate transfer belt 120 by the nozzle 141 so as to be overlapped with each other in synchronization with the circular movement of the intermediate transfer belt 120 in the direction of the arrow B. Positions where the nozzles 141 are disposed are an example of the "image formation position" of the present disclosure. Ink images S transferred so as to be sequentially overlapped with each other are transported to a transfer position T in accordance with the circular movement of the intermediate transfer belt 120.

Meanwhile, a sheet P is taken out from a sheet tray (not illustrated) and transported in a direction of an arrow Z4 so as to reach the transfer position T at a timing at which an ink image S on the intermediate transfer belt 120 is transported to the transfer position T. Then, at the transfer position T, the ink image S on the intermediate transfer belt 120 is transferred onto the sheet P. This transfer position T is an example of the "transfer position" of the present disclosure.

The sheet P receiving the ink image S proceeds in the direction of the arrow Z4 and is discharged to an outside of the image forming apparatus 110. During this process, the ink image S on the sheet P is dried and fixed on the sheet P.

Residual ink on the intermediate transfer belt 120 after the transfer proceeds in the direction of the arrow B in accordance with the circular movement of the intermediate transfer belt 120, and is removed from the intermediate transfer belt 120 by a cleaning device 160 including a cleaning blade 161 pressed against the tension roller 132 with the intermediate transfer belt 120 sandwiched therebetween.

The image forming apparatus 110 includes another cleaning device 170. The cleaning device 170 is disposed inside the intermediate transfer belt 120, and is in direct contact with the tension roller 132 without the intermediate transfer belt 120 being sandwiched therebetween, to scrape off foreign matter adhering to the tension roller 132.

The cleaning device 170 has a structure in which a blade 172 is fixed to a leading end of a housing 171. In the present exemplary embodiment, the blade 172 includes, for example, a PET film. A leading end edge 172*a* of the blade 172 is in contact with the tension roller 132. The housing 171 is fixed to a support member 173 via a solenoid 174. A support member 173 has a length such that both sides of the tension roller 132 in a rotation axis direction, that is, in a width direction of the intermediate transfer belt 120, protrude from the intermediate transfer belt 120. The both sides protruding from the intermediate transfer belt 120 are fixed to a frame (not illustrated) of the image forming apparatus 110.

The support member 173 has a length such that both sides of the tension roller 132 in a rotation axis direction, that is, in a width direction of the intermediate transfer belt 120, protrude from the intermediate transfer belt 120. The both sides protruding from the intermediate transfer belt 120 are fixed to a frame (not illustrated) of the image forming apparatus 110.

The cleaning device 170 moves to a position Xl and a position X2 by an operation of the solenoid 173. With this movement, a contact state of the blade 172 with the tension roller 132 is changed.

In the inkjet image forming apparatus 110, plural types of foreign matter such as an ink mass and a resin fragment may be scattered in an internal space of the image forming apparatus 110, and a part of the foreign matter may adhere to the tension roller 132. The cleaning device 170 changes its position between the position X1 and the position X2. Accordingly, similar to the image forming apparatus 10 of the first exemplary embodiment described above, the plural types of foreign matters adhering to the tension roller 132 are efficiently removed.

As described above, the electrostatic transfer image forming apparatus 10 including the intermediate transfer belt 20 and the inkjet image forming apparatus 110 including the intermediate transfer belt 120 have been described as examples. The present disclosure is widely applicable to image forming apparatuses including a belt that is wound around plural rollers to circulate and move, that carries an image formed at a predetermined image formation position, and that transfers the image to an object to be transferred at a predetermined transfer position.

The present disclosure is not limited to the image forming apparatuses. The present disclosure is widely applicable to (i) belt rotating devices including a belt that is wound around plural rollers to circulate and move and (ii) various apparatuses including any of such belt rotating devices.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt rotating device comprising:

a belt wound around a plurality of rollers configured to circulate, the plurality of rollers including a roller to be cleaned; and a first cleaning unit disposed inside the belt, the first cleaning unit being in contact with at least the roller to be cleaned to scrape off foreign matter on the roller to be cleaned, the first cleaning unit being configured to change a contact angle with respect to the roller to be cleaned.

2. An image forming apparatus comprising:

a belt wound around a plurality of rollers configured to circulate, the plurality of rollers including a roller to be cleaned, an image being formed on the belt at a predetermined image formation position, the belt being configured to carry the image and transfer the image to an object to be transferred at a predetermined transfer position; and a first cleaning unit disposed inside the belt, the first cleaning unit being in contact with at least the roller to be cleaned to scrape off foreign matter on the roller to be cleaned, the first cleaning unit being configured to change a contact angle with respect to the roller to be cleaned.

3. The image forming apparatus according to claim 2, wherein the first cleaning unit comprises a film-shaped member pressed against the roller to be cleaned, the first cleaning unit configured to be pressed against the film-shaped member against the roller to be cleaned, to scrape off the foreign matter on the roller to be cleaned.

4. The image forming apparatus according to claim 3, wherein the image forming apparatus has a cleaning mode in which the belt is circulated and moved with the belt carrying no image to be transferred onto the object to be transferred.

5. The image forming apparatus according to claim 4, further comprising:

a second cleaning unit, wherein the belt comprises a front surface, and a back surface opposite to the front surface, the back surface being in contact with the roller to be cleaned, and the second cleaning unit is in contact with the front surface of the belt at a position downstream of the transfer position in a circulation direction in which the belt circulates and upstream of the image formation position in the circulation direction, so as to sandwich between the second cleaning unit and the roller to be cleaned.

6. The image forming apparatus according to claim 5, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

7. The image forming apparatus according to claim 4, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

8. The image forming apparatus according to claim 3, further comprising:

a second cleaning unit, wherein the belt comprises a front surface, and a back surface opposite to the front surface, the back surface being in contact with the roller to be cleaned, and the second cleaning unit is in contact with the front surface of the belt at a position downstream of the transfer position in a circulation direction in which the belt circulates and upstream of the image formation position in the circulation direction, so as to sandwich between the second cleaning unit and the roller to be cleaned.

9. The image forming apparatus according to claim 8, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

10. The image forming apparatus according to claim 3, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

11. The image forming apparatus according to claim 2, wherein the image forming apparatus has a cleaning mode in which the belt is circulated and moved with the belt carrying no image to be transferred onto the object to be transferred.

12. The image forming apparatus according to claim 11, further comprising:

a second cleaning unit, wherein the belt comprises a front surface, and a back surface opposite to the front surface, the back surface being in contact with the roller to be cleaned, and the second cleaning unit is in contact with the front surface of the belt at a position downstream of the transfer position in a circulation direction in which the belt circulates and upstream of the image formation position in the circulation direction, so as to sandwich between the second cleaning unit and the roller to be cleaned.

13. The image forming apparatus according to claim 12, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

14. The image forming apparatus according to claim 11, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

15. The image forming apparatus according to claim 2, further comprising:

a second cleaning unit, wherein the belt comprises a front surface, and a back surface opposite to the front surface, the back surface being in contact with the roller to be cleaned, and the second cleaning unit is in contact with the front surface of the belt at a position downstream of the transfer position in a circulation direction in which the belt circulates and upstream of the image formation position in the circulation direction, so as to sandwich the belt between the second cleaning unit and the roller to be cleaned.

16. The image forming apparatus according to claim 15, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

17. The image forming apparatus according to claim 2, wherein the image forming apparatus has a first mode and a second mode in which the roller to be cleaned changes a relative position of the roller to be cleaned with respect to the first cleaning unit, and changing the relative position of the roller to be cleaned with respect to the first cleaning unit changes the contact angle of the first cleaning unit with respect to the roller to be cleaned between the first mode and the second mode.

18. The image forming apparatus according to claim 17, wherein the first mode is a mode in which a color image is carried on the belt, the second mode is a mode in which a monochrome image is carried on the belt, and the roller to be cleaned is a roller configured to apply tension to the belt and change the position the roller to be cleaned between the first mode and the second mode.

19. The image forming apparatus according to claim 17, further comprising:

a measuring unit configured to measure a ratio of operation in the first mode and a ratio of operation in the second mode, wherein when the ratio of the operation in the first mode is higher than a predetermined first ratio, the roller to be cleaned is moved to a position of the roller to be cleaned in the second mode, and a cleaning mode is executed.

20. The image forming apparatus according to claim 17, further comprising:

a measuring unit configured to measure a ratio of operation in the first mode and a ratio of operation in the second mode, wherein when the ratio of the operation in the second mode is higher than a predetermined second ratio, the roller to be cleaned is moved to a position of the roller to be cleaned in the first mode, and a cleaning mode is executed.

* * * * *